US007242896B2

(12) United States Patent
Haseba et al.

(10) Patent No.: US 7,242,896 B2
(45) Date of Patent: Jul. 10, 2007

(54) FIXING DEVICE AND IMAGE FORMING APPARATUS

(75) Inventors: Shigehiko Haseba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 265 days.

(21) Appl. No.: 11/052,218

(22) Filed: Feb. 8, 2005

(65) Prior Publication Data

US 2005/0265758 A1 Dec. 1, 2005

(30) Foreign Application Priority Data

May 31, 2004 (JP) ..... P2004-161216

(51) Int. Cl.
*G03G 15/20* (2006.01)

(52) U.S. Cl. ..... 399/329

(58) Field of Classification Search ..... 399/67, 399/69, 122, 320, 328, 329; 219/216
See application file for complete search history.

(56) References Cited

U.S. PATENT DOCUMENTS 5,528,351 A 6/1996 Tsuji
6,674,978 B1 * 1/2004 Suzuki et al. ..... 399/67
6,734,397 B2 * 5/2004 Kato et al. ..... 219/216
7,010,256 B2 * 3/2006 Usui et al. ..... 399/328
2002/0094212 A1 * 7/2002 Suzumi ..... 399/69
2003/0077092 A1 * 4/2003 Ogawa et al. ..... 399/328

FOREIGN PATENT DOCUMENTS

JP 7-287460 10/1995
JP 2001-51530 2/2001

* cited by examiner

*Primary Examiner*—Hoan Tran
(74) *Attorney, Agent, or Firm*—Morgan, Lewis & Bockius LLP

(57) ABSTRACT

A fixing device includes a pressure roll having elasticity or flexibility which is a driving roller, a heat-resistant endless belt being in contact with the pressure roll to form a nip zone through which a recording medium passes, the heat-resistant endless belt rotating as driven by the pressure roll, a pressing supporting body disposed inside the heat-resistant endless belt and having a flat segment to press the heat-resistant endless belt for making the nip zone nearly flat, a heat source disposed inside the heat-resistant endless belt, the pressing supporting body being arranged between the heat source and the nip zone. Preferably, the heat-resistant endless belt is directly heated by radiant heat from the heat source and heated by thermal conduction through the pressing supporting body.

19 Claims, 5 Drawing Sheets

FIXING DEVICE AND IMAGE FORMING APPARATUS

BACKGROUND OF THE INVENTION

1. Field of the Invention

This invention relates to a fixing device for fixing an unfixed image on carried on the surface of a recording medium onto the recording medium by heating and pressurizing the recording medium, and an image forming apparatus provided with the fixing device.

2. Description of the Related Art

As an image forming technique, an electrophotographic system has become widespread because it have many advantages that the printing speed is high, the preparation of the printing plate is not required each time, an image can be directly acquired from various items of image information, the apparatus size is relatively small, full-coloring can be easily realized, etc.

In the image forming apparatus (electrophotographic apparatus) which adopts the electrophotographic system, generally, by bringing charged toner into contact with the surface of a latent image carrier on which an electrostatic latent image is formed, toner is selectively applied to the surface of the latent image carrier to form a toner image. The toner image is transferred onto a recording medium through or not through an intermediate transfer body. The toner is fixed on the surface of the recording medium by heat and/or pressure, thereby providing an image.

In such an electrographic apparatus, generally, a fixing device in a two-roll system composed of a heating roll and a pressure roll kept in contact with each other is employed for fixing. Bypassing the recording medium, on the surface of which the unfixed toner image is formed, through a nip zone formed through contact of both rolls, the toner is molten by heat and pressure so that the toner image is fixed on the surface of the recording medium as a permanent image. As the case may be, in place of the heating roll and/or pressure roll, the heating member and/or pressure member each having an endless belt shape are employed.

The heating roll is a metallic core incorporating a heat source such as a halogen lamp, which is covered with an elastic layer or releasing layer. The surface of the heating roll is heated internally by the heat source. From the viewpoint of energy saving and preventing a user from waiting in using the image forming apparatus, it has been demanded for the fixing device that the hearing member such as the heating roll can be heated instantaneously to minimize the warm-up time.

A related art fixing device includes a fixing roll (heating roll) which is a hollow fixing body, a pressure roll which is pressed on the fixing roll by an urging unit and a halogen heater (fixing heater) serving as a heating unit. In this fixing device, electric power is supplied from a power source to the halogen heater so that the fixing roll is heated. An output from a sensor to detect the surface temperature of the fixing roll is supplied to a temperature control. The halogen heater is ON/OFF controlled on the basis of the above output by the temperature control so that the fixing roll is kept at a predetermined surface temperature. The unfixed image of the unfixed toner carried on the recording medium is heated and pressurized together with the recoding medium within the fixing nip formed by the fixing roll and pressure roll so that it is permanently fixed.

Owing to difficulty of forming a free shape of the fixing nip, the conventional fixing roll having a hollow cylindrical shape presented such inconvenience that the recording medium is wrinkled or curled, transportability is affected and limitation is given to improve the fixing property. It was difficult to obviate such inconvenience for all of various recording media by the conventional fixing roll.

For example, in the recording medium having a two or more multiple-layer structure such as an envelope, if the shape of the nip zone between the fixing roll and the pressuring roll is not planar but has a curvature, even with equal rotary speeds of both rolls, a slight difference occurs in their linear speed on the surface to give a difference in the transporting speed between the upper and lower surfaces of the recording medium. This may lead to inconvenience such as wrinkle of recording medium and affection on the capability of fixing and feeding (transportation). Particularly, when the process speed is increased, the above inconvenience is likely to occur.

In order to solve the above problem, the technique disclosed in JP-A-7-287460 has been proposed. The technique is a fixing device including a hollow pipe incorporating a heat source, a pressure roll for pressuring the hollow pipe and a heat-resistant endless sheet wound around the hollow pipe, wherein a recording sheet (recording medium) carrying unfixed toner is passed between the endless sheet and the pressure roll to implement the fixing by heating/pressurizing. In this fixing device, the surface carrying the unfixed toner of the recording sheet is in contact with the endless sheet which rotation-moves at the speed equal to the feeding or transporting speed of the recording sheet, and the pressed position of the hollow pipe by the pressure roll is practically planar.

In such a fixing device, however, the entire hollow pipe is heated by the halogen heater so that the area other than the nip zone of the hollow pipe which does not contribute to fixing is also heated. This leads to a problem that it takes a long time to increase the temperature of the entire fixing member to a predetermined temperature, thereby not shortening the warm-up time.

Where recording sheets are continuously fed, since heat is absorbed by the recording sheet, the temperature falls. In order to keep the nip zone of the hollow pipe at a predetermined temperature, heating must be carried out from the heat source. However, the area opposite to the nip zone with respect to the heat source in the hollow pipe, where heat is not absorbed, is rapidly heated to a high temperature. As a result, in order to reduce the temperature of the pertinent area to a predetermined temperature or lower, it is necessary to reduce the printing speed and stop the printing.

SUMMARY OF THE INVENTION

In view of the above circumstance, this invention provides a fixing device which generates no wrinkle or curl regardless of the type of a recording medium during fixing, is good in the capability of feeding and fixing, is excellent in the capability of instant start (realizing shortening of the warm-up time), can suppress the trouble such as stopping of printing and is excellent in the aptitude of high speed, and provide an image forming method using this fixing device.

According to an aspect of the present invention, a fixing device includes a pressure roll having elasticity or flexibility which is a driving roller, a heat-resistant endless belt being in contact with the pressure roll to form a nip zone through which a recording medium passes, the heat-resistant endless belt rotating as driven by the pressure roll, a pressing supporting body disposed inside the heat-resistant endless belt and having a flat segment to press the heat-resistant endless belt for making the nip zone nearly flat, a heat source disposed inside the heat-resistant endless belt, the pressing supporting body being arranged between the heat source and the nip zone. Preferably, the heat-resistant endless belt is directly heated by radiant heat from the heat source and heated by thermal conduction through the pressing supporting body.

According to another aspect of the present invention, a fixing device includes a pressure roll having elasticity or flexibility which is a driving roller, a heat-resistant endless belt being in contact with the pressure roll to form a nip zone through which a recording medium passes, the heat-resistant endless belt rotating as driven by the pressure roll, a pressing supporting body disposed inside the heat-resistant endless belt and having a flat segment to press the heat-resistant endless belt for making the nip zone nearly flat, a heat source disposed inside the heat-resistant endless belt, the pressing supporting body being arranged between the heat source and the nip zone. Preferably, the pressing supporting body is extended centering the flat segment along an inner periphery of the heat-resistant endless belt to surround the heat source and has an opening at a position opposite to the flat segment.

According to yet another aspect of the present invention, an image forming apparatus includes an image forming unit that forms an unfixed image on a surface of a recording medium, and a fixing unit that fixes the unfixed image formed on the surface of the recording medium by heating and pressurizing. Preferably, the fixing unit includes a pressure roll having elasticity or flexibility, which is a driving roller, a heat-resistant endless belt being in contact with the pressure roll to form a nip zone through which a recording medium passes, the heat-resistant endless belt rotating as driven by the pressure roll, a pressing supporting body disposed inside the heat-resistant endless belt and having a flat segment to press the heat-resistant endless belt for making the nip zone nearly flat, a heat source disposed inside the heat-resistant endless belt, the pressing supporting body being arranged between the heat source and the nip zone. Preferably, the heat-resistant endless belt is directly heated by radiant heat from the heat source and heated by thermal conduction through the pressing supporting body.

According to still another aspect of the present invention, an image forming apparatus includes an image forming unit that forms an unfixed image on a surface of a recording medium, and a fixing unit that fixes the unfixed image formed on the surface of the recording medium by heating and pressurizing. Preferably, the fixing unit includes a pressure roll having elasticity or flexibility, which is a driving roller, a heat-resistant endless belt being in contact with the pressure roll to form a nip zone through which a recording medium passes, the heat-resistant endless belt rotating as driven by the pressure roll, a pressing supporting body disposed inside the heat-resistant endless belt and having a flat segment to press the heat-resistant endless belt for making the nip zone nearly flat, a heat source disposed inside the heat-resistant endless belt, the pressing supporting body being arranged between the heat source and the nip zone. Preferably, the pressing supporting body is extended centering the flat segment along an inner periphery of the heat-resistant endless belt to surround the heat source and has an opening at a position opposite to the flat segment.

BRIEF DESCRIPTION OF THE DRAWINGS

Embodiments of the present invention will be described in detail based on the following figures, wherein.

DETAILED DESCRIPTION OF THE INVENTION

A detailed explanation of this invention will be given with reference to embodiments.

EMBODIMENT 1

Figure 1:
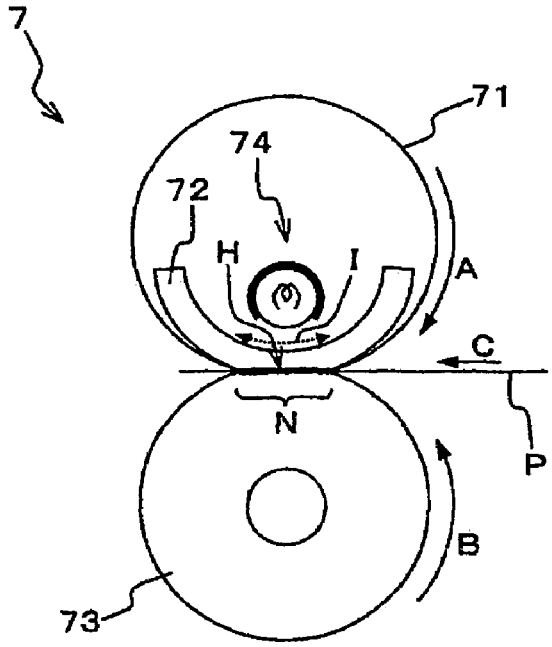
FIG. 1 is a schematic sectional view of a fixing device according the first embodiment which is an example of the fixing device according to this invention.
Figure 2:
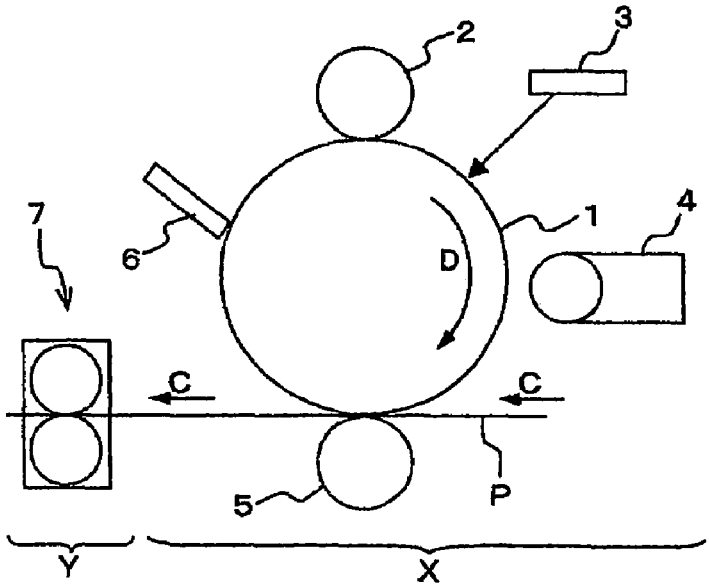
FIG. 2 is a schematic configuration view of the image forming apparatus provided with the fixing device shown in FIG. 1.

FIG. 1 is a schematic sectional view of a fixing device according the first embodiment which is an example of the fixing device according to this invention. FIG. 2 is a schematic configuration view of the image forming apparatus provided with such a fixing device.

As seen from FIG. 2, this image forming apparatus roughly includes two units of an image forming unit X and a fixing unit Y.

The image forming unit. X is provided with a photosensitive drum (latent image carrier) 1 on the surface of which a latent image due to a difference in the electrostatic potential is formed by being irradiated with an image-like light beam after uniformly charged, the photoconductive drum rotates in a direction of arrow D. The image forming unit 1, around the photoconductive drum 1, in sequence in the rotating direction (direction of arrow D), includes a charging roll 2 for uniformly charging the surface of the photosensitive drum 1, an image exposing device (latent image forming unit) 3 for irradiating the photosensitive drum 1 with an image-like light beam to form an electrostatic latent image on the surface, a developing device to selectively shift toner to the latent image formed on the surface of the photosensitive drum 1 to form a toner image (unfixed image) a transfer roll opposite to the photosensitive drum 1 for creating a transfer bias electric field between itself and the photosensitive drum 1 between which a recording sheet P is sandwiched, and a cleaner (cleaning member) to remove the toner remaining on the photosensitive drum after the toner image has been transferred.

A sheet feeding mechanism (not shown) is arranged so that the recording sheet P is fed in a direction of arrow C from the upstream side (right side in FIG. 2) toward the opposite area between the photosensitive drum 1 and transfer roll 5. The toner image is transferred to the surface of the recording sheet P fed to the opposite area by means of the transfer roll 5. Namely, in the image forming unit X, the toner image (unfixed image) is formed on the surface of the recording sheet (recording medium) P.

On the other hand, the fixing unit Y, which is located at the downstream side of the image forming unit X in the direction (direction of arrow C) of feeding the recording sheet P, is constructed of a fixing device 7 for heating/melting the toner image transferred on the surface of the recording sheet P to be applied onto the recoding sheet P. The fixing device 7 is a fixing device according to the first embodiment shown in FIG. 1.

An explanation will be given of the operation of the image forming unit X.

The photosensitive drum 1 may be a photosensitive layer of an organic photosensitive material, amorphous selenium photosensitive material or amorphous silicon photosensitive material formed on the surface of a metallic drum.

The charging roll 2 may be a metallic roll having conductivity such as stainless steel or aluminum coated with a high resistance material. The charging roll 2 is in contact with the photosensitive drum 1 and rotates to follow the photosensitive drum 1. A predetermined voltage is applied to the charging roll 2 so that continuous discharging occurs in a minute gap in the vicinity of the contact area between the charging roll 2 and the photosensitive drum 1, thereby virtually uniformly charging the surface of the photosensitive drum 1.

The image exposing device 3 emits a laser beam which blinks on the basis of an image signal. The laser beam thus emitted scans photosensitive drum 1 through a polygonal mirror in its main scanning direction. Thus, the electrostatic latent image is formed on the surface of the photosensitive drum 1.

The developer 4 contains black toner. With the developing roll carrying the toner being located to be opposite and close to the photosensitive drum 1, the developer 4 shifts the toner according to the electrostatic latent image formed on the surface of the photosensitive drum 1, thereby forming (developing) a visualized toner image (unfixed image).

The transfer roll 5 is a conductive or semiconductive roll-shaped member. At a biasing voltage for transfer applied between the photosensitive drum 1 and itself, the transfer roll 5 transfers the toner image on the surface of the photosensitive drum 1 onto the recording sheet P.

The cleaner 6 is a blade-like member to be pressed on the surface of the photosensitive drum 1, and scratching-removes the toner remaining on the surface of the photosensitive drum 1. In place of the blade-like member, the cleaner may be a rolling member which scratches the toner or a brush which sweeps out the toner.

Next, referring to FIG. 1, an explanation will be given of the operation of the fixing unit Y.

The fixing device according to this embodiment shown in FIG. 1 includes a halogen lamp (heat source) 74 producing an output of 500 W to 1000 W, a pressing supporting body 72 having a flat segment H and arranged to surround the halogen lamp, a heat-resistant fixing belt (heat-resistant endless belt) 71 hung to encircle the outer periphery of the pressing supporting body 72, and a pressure roll 73 for pressuring through the fixing belt 71 at a position of the flat segment H of the pressing supporting body 72. A nip zone N is formed between the fixing belt 71 and the pressure roll 73. By passing the recording sheet P carrying the unfixed toner image through the nip zone N in a direction of arrow C, the fixing by heating/pressurizing is carried out.

The pressing supporting body 72 is opened on the side opposite to the flat segment H. The halogen lamp 74 is arranged at a position deviated from the axial central position of the fixing belt 71 by 7 mm toward the nip zone N so as to heat mainly the nip zone N. The pressing supporting body 72 is arranged to surround the periphery of the halogen lamp 74 over the central angle of 270° with the halogen lamp 74 (more specifically, filament within the halogen lamp 74) as the base point. In this invention, the central angle is preferably in a range from 180° to 300°, and more preferably in a range from 200° to 240°.

The pressing supporting body 72 is made of a material with good endurance and heat resistance such as iron and aluminum.

Figure 3:
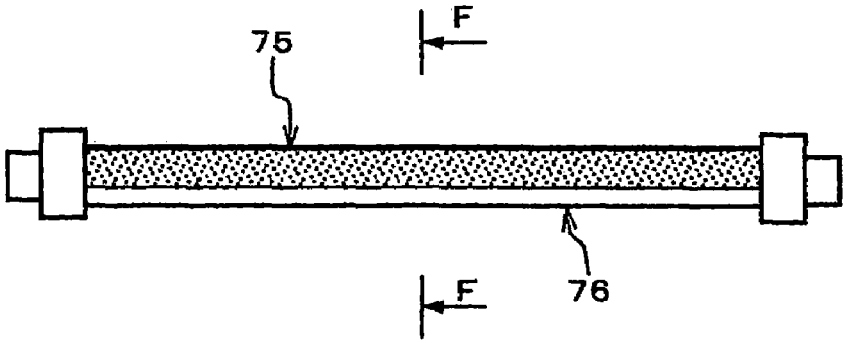
FIG. 3 is a front view a halogen lamp (heat source) in the fixing device shown in FIG. 1.
Figure 4:
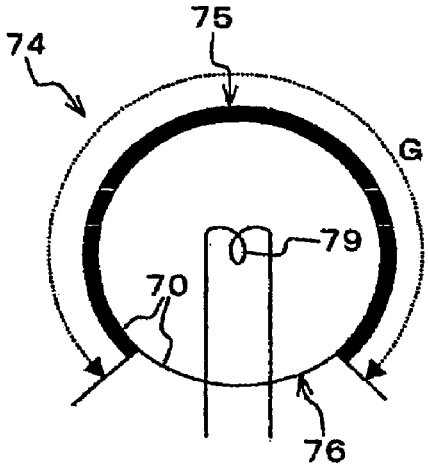
FIG. 4 is an enlarged sectional view taken in line F-F in FIG. 3.

FIG. 3 is a view (front view) of the halogen lamp 74 when viewed from the upstream side of the direction of feeding the recording sheet P in FIG. 1. FIG. 4 is an enlarged sectional view taken in line F-F in FIG. 3. As seen from FIG. 3, the halogen lamp 74 includes a radiating portion 76 for heating the back of the flat segment H of the pressing supporting body 72 and a white ceramic coating portion (thermal semi-shielding member) 75 formed on the outside of the lamp tube on the side opposite to the nip zone N. The white ceramic coating portion 75 is coated with white ceramic which reflects the light from the lamp filament. The white ceramic coating portion 75 reflects the radiant heat from the halogen lamp 74 by about 60% of the entire energy of the radiant heat. Since the radiant heat of about 60% is reflected, the remaining 40% radiant heat is employed to directly heat the fixing belt 71 by radiation.

In this embodiment, the white creaming coating was adopted as the thermal semi-shielding member. In this invention, the thermal semi-shielding member may be any member as long as it can shield (interrupt or reflect) a part of the entire energy of the radiant heat through either reflection or absorption. Concretely, the thermal semi-shielding member may be any member which mainly shields 10 to 90% of the entire energy of the radiant heat. Preferably, it is the member capable of shielding 10 to 50%, and more preferably, it is the member capable of shielding 10 to 30%. Incidentally, from the viewpoint of thermal efficiency, the thermal semi-shielding member preferably has a property of reflecting the radiant heat like a white member. From the viewpoint of heat resistance and moldability, the ceramic coating is preferably adopted.

Thus, the fixing belt 71 can be directly heated from the radiant heat from the halogen lamp 74 on the side opposite to the nip zone N where the pressing supporting body 72 is opened. Further, the fixing belt 71 can be indirectly heated by thermal conduction through the pressing supporting body 72. Specifically, at the nip zone where heat is absorbed, the fixing belt 71 can be heated by the thermal conduction through the pressing supporting body 72. The fixing belt 71 with heat absorbed at the nip zone can be heated by the radiant heat from the halogen lamp 74 at the position apart from the nip zone N. Thus, as a whole, the fixing belt 71 can be effectively given heat so that the temperature of the fixing belt 71 and pressing supporting body 72 at the nip zone N can be easily and suitably controlled to a prescribed temperature. Further, since the heating is effectively done, shortening of the warm-up time can be attained.

The amount of coating of the white ceramic coating portion 75 may be controlled in view of the degree of temperature rise in the fixing belt 71 and pressing supporting body 72, and may be suitably controlled according to the material, thickness, thermal capacity and making electric power of the pressing supporting body 72.

The halogen lamp 74 serving as the heat source, as seen from FIG. 4, includes a filament 79 located at the axial center of a cylindrical glass lamp tube 70 and the white ceramic coating portion 75 coated with white ceramic at a partial area G of the periphery of the lamp tube 70. In this invention, the range of the area G is preferably over the central angle of 180° to 270°, more preferably over the central angle of 240° to 270° with the filament 79 as the base point (center). By arranging the thermal semi-shielding member in this range, the flat segment H of the pressing supporting body 72 corresponding to the nip zone N can be positively heated, thereby preventing the other area than the fixing belt 71 and the flat segment H of the pressing supporting body 72 from being excessively heated. In this embodiment, the above coating portion 75 is coated with the white ceramic over the range of the central angle of 270°.

Figure 5:
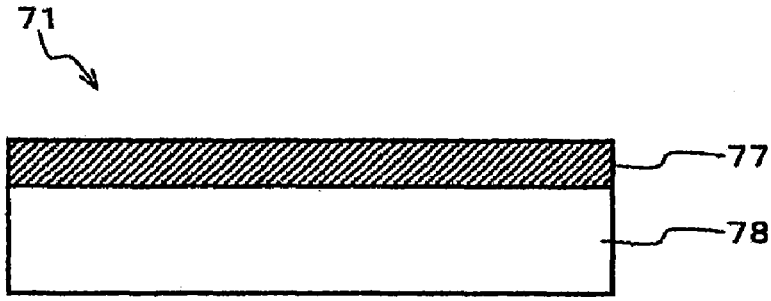
FIG. 5 is an enlarged sectional view of a fixing belt in the fixing device shown in FIG. 1.

FIG. 5 is an enlarged sectional view of the fixing belt 71. As seen from FIG. 5, the fixing belt 71 consists of a releasing layer 77 and heat-absorbing layer 78. The releasing layer 77 is made of a material with excellent releasiability and durability (e.g. a polyimide resin or fluororesin, PFA in this embodiment) having a thickness of about 1 to 30 μm. The heat-absorbing layer 78 is made of a mixture composed of the polyimide resin having a thickness of 40 μm to 80 μm (80 μm in this embodiment) and carbon black. Like this, the fixing belt 71 preferably includes the heat-absorbing layer subjected to the treatment for forming the thermal absorbance (thermal absorbing treatment) so that the radiant heat from the halogen lamp 74 can be easily absorbed by the fixing belt 71. As another example, the heat absorbing layer may be made of a mixture of PFA and carbon black. In this case, the fixing belt having both releasiablity and thermal absorbency can be made in a single layer structure of this heat absorbing layer.

The pressing supporting body 72 is preferably subjected to the thermal absorbing treatment on at least the surface opposite to the halogen lamp 74 at the flat segment H (area indicated by dotted arrow I in FIG. 1). If at least this area is subjected to the thermal absorbing treatment such as blackening treatment, the radiant heat can be easily absorbed from the halogen lamp 74 serving as the heat source, thus improving the thermal efficiency.

On the other hand, the pressure roll 73 is a "soft roll" with an elastic layer made of a material with high elasticity e.g. urethane formed on a metallic core. Since the pressure roll 73 is the soft roll, the pressure roll 73 is suitably dented at the nip zone N so that its shape at the nip zone N becomes nearly flat under the influence of the flat segment H of the pressing supporting body 72.

Incidentally, the surface of the pressure roll 73 must have elasticity or flexibility to such a degree that it becomes nearly flat in contact with the flat segment H of the pressing supporting body 72. The pressure roll 73 maybe made of one of various materials suitably selected according to the purpose.

Since the flat segment H of the pressing supporting body 72 is nearly flat, sufficient pressuring force is applied to the fixing belt 71 by the pressure roll 73. Thus, when the pressure roll 73 is rotated, both the fixing belt 71 and recording sheet P are fed and the nip zone N is formed in a flat shape so that the feeding speeds (linear speeds) of both become approximately equal, thereby preventing paper wrinkles or curls from occurring.

As described above, in the fixing device according to this embodiment, the liner speed is not different between the fixing belt 71 and the pressure roll 73 at the nip zone N. For this reason, even when the recording sheet P is a recording medium in a multi-layer structure such as an envelope, improved characteristics of feeding and fixing can be attained with no wrinkle or curl.

Since the fixing belt (heat-resistant endless belt) 71 is employed as a fixing member on the fixing side, the instant-start capability is inherently excellent. In addition, since the nip zone N is heated by the thermal conduction through the pressing supporting body and the other area than the nip zone N is heated by the radiant heat from the halogen lamp 74, the temperature fall in the heat-resistant endless belt is suppressed, thereby further improving the instant-start capability and also giving excellency in the aptitude of high speed.

Incidentally, in this embodiment, the fixing device for monochromatic use was explained, but the same effect can be also expected for the fixing device for color use using the fixing belt including an elastic layer.

EMBODIMENT 2

Figure 6:
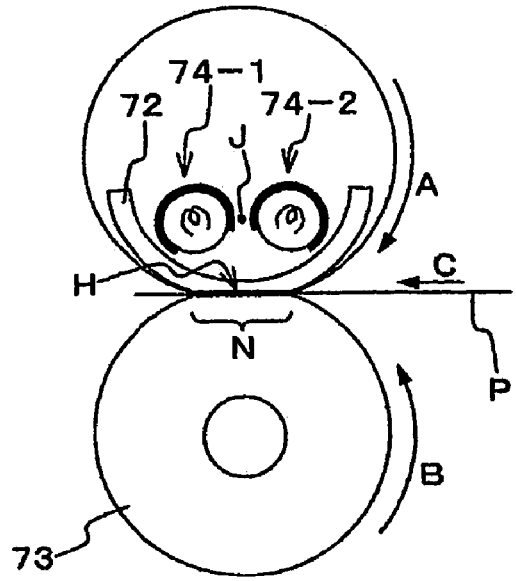
FIG. 6 is a schematic sectional view of a fixing device according the second embodiment which is another example of the fixing device according to this invention.

FIG. 6 is a schematic sectional view showing a fixing device according to the second embodiment which is another example of the fixing device according to this invention. The fixing device according to this embodiment includes a plurality of halogen lamps each serving as the heat source. The fixing device according to this embodiment includes a lot of elements having the same construction as those in the first embodiment. The elements with the same reference numerals as those in FIG. 6 are not given the detailed explanation. Further, in place of the fixing device 7, this embodiment can be applied to the image forming apparatus having the same configuration as shown in FIG. 1 in the first embodiment, illustration or its detailed explanation of the image forming apparatus will not be given.

The fixing device according to this embodiment shown in FIG. 6 is structured to include two halogen lamps (heat sources) 74-1 and 74-2. Where it is intended in this invention that a plurality of halogen lamps are employed, the number thereof should not be limited to two, but may be three or more. In the fixing device according to this embodiment, as the heat source, two halogen lamps, i.e. the halogen lamp 74-1 employed where the recording sheet P has a full size and the halogen lamp 74-2 employed where the recording sheet P has a small size are arranged in a state surrounded by the pressing supporting body 72 within the fixing belt 71.

The pressing supporting body 72 is the same as that in the first embodiment in their structure, composition, etc. However, since there are the plurality of halogen lamps, which are the standard for determining to what degree the pressing supporting body 72 should surround the halogen lamp (heat source), the standard prescribed in the first embodiment cannot be adopted as it is. For this reason, where there are the plurality of heat sources, using, as the base point, the center of gravity of the graphic connecting the center points of the respective heat sources, the standard in the first embodiment is adopted. Where there are two heat sources (halogen lamps 74-1 and 74-2) as in this embodiment, the center point (point J in FIG. 6 in this embodiment) of the line segment connecting the filaments of both halogen lamps is used as the base point.

The halogen lamps 74-1 and 74-2 are arranged at positions deviated from the axial central position of the fixing belt 71 toward the nip zone N (the central point J of both halogen lamps is deviated by 7 mm from the axial central point toward the nip zone N).

In order to control the surface of the fixing belt 71 to a predetermined temperature, a temperature detecting sensor for detecting the surface temperature of the fixing belt 71 is arranged in the vicinity of the surface of the fixing belt 71 at the upstream side of the nip zone, and the output of the detected result is supplied to a temperature control. On the basis of the output of the detected result, the temperature control individually ON/OFF controls the halogen lamps 74-1 and 74-2. Thus, the fixing belt 71 is kept at a predetermined surface temperature.

As in the first embodiment, the halogen lamps 74-1 and 74-2 have the shape and structure as shown in FIGS. 3 and 4 as in the first embodiment, and arranged so that their radiating portions 76 are opposite to the center of the nip zone N.

The other construction, which is the same as that in the first embodiment, will not be explained. The operation, function and mode of the fixing device according to this embodiment, which are the same as in the first embodiment, will not also be explained.

As described above, the construction of this invention can be applied, with no problem, to the fixing device provided with a plurality of heat sources, and hence equally presents an excellent effect.

EMBODIMENT 3

Figure 7:
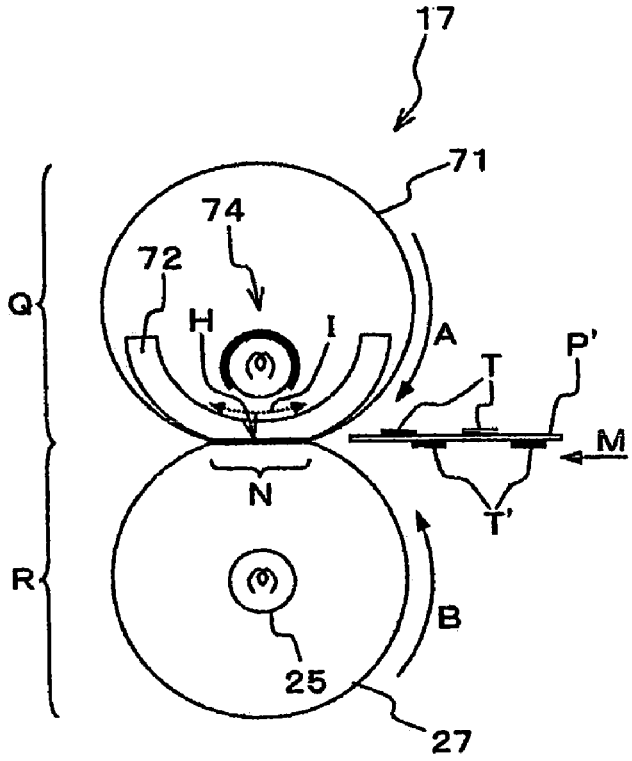
FIG. 7 is a schematic sectional view of a fixing device according the third embodiment which is still another example of the fixing device according to this invention.
Figure 8:
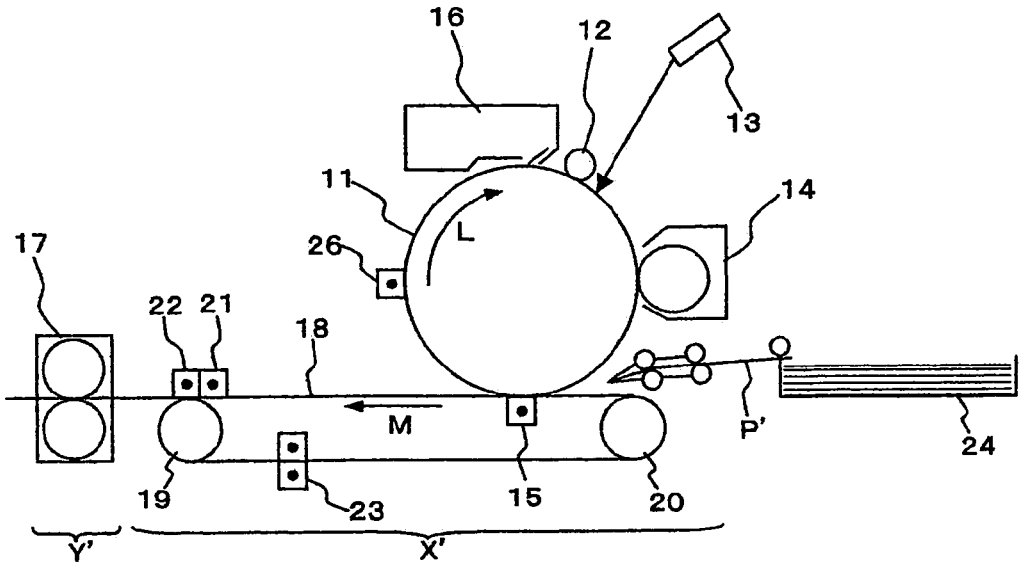
FIG. 8 is a schematic configuration view of the image forming apparatus provided with the fixing device shown in FIG. 7.

FIG. 7 is a schematic sectional view showing the fixing device according to the third embodiment which is still another example of the fixing device according to this invention. FIG. 8 is a schematic construction view of an image forming apparatus (digital copier) provided with such a fixing device.

As shown in FIG. 8, this image forming apparatus roughly includes two units of an image forming unit X' and a fixing unit Y'.

The image forming unit X' is provided with a photosensitive drum (latent image carrier) 11 on the surface of which a latent image due to a difference in the electrostatic potential is formed by being irradiated with an image-like light beam after uniformly charged, the photoconductive drum rotates in a direction of arrow L. The latent image is formed at a latent image writing position by a light beam writing device (latent image forming unit) 13. Around the photosensitive drum 11, a charging roll 12 such as a corotron is arranged. The image forming unit X', around the photoconductive drum 11, in sequence in the rotating direction (direction of arrow L) of the photosensitive drum 11 from the charging roll 12, a developer 14 containing toner, a first transfer device 15 for creating a transfer bias electric field between itself and the photosensitive drum 1 between which a recording sheet P' and a transfer/feed belt 18 are sandwiched, a discharging corotron (discharger) for removing the residual charge on the surface of the photosensitive drum 11, and a cleaner (cleaning member) 16 for removing the toner remaining on the photosensitive drum 11.

The transfer device 15 is arranged at a first transfer position where the unfixed toner image (unfixed image) formed on the surface of the photosensitive drum 11 is transferred to the transfer/feed belt 18 and the first surface (upper surface) of the recording sheet P'.

As seen from FIG. 8, the transfer/feed belt 18 has an endless shape, and is rotatably/movably hung over a driving roll 19 and a following roll 20. The driving roll 19 is adapted to be rotation-driven by a driving motor (not shown) and rotates the transfer/feed belt 18 in a direction of arrow M. Thus, the transfer/feed belt 18 has an upper part moving in a direction from the following roll 20 toward the driving roll 19 and a lower part moving in the opposite direction.

A second transfer device 21 is arranged at a second transfer position adjacent to the driving roll 19, which is a downstream end (upper left end of the drawing) of the upper part of the transfer/feed belt 18. Adjacently to the second transfer device 21 on a further downstream side, an exfoliating corotron 22 is arranged. At the lower part of the transfer/feed belt 18, a pair of discharging corotrons 23 are arranged to sandwich the transfer/feed belt 18. Thus, the transfer/feed belt 18 is discharged.

The recording sheet P' taken out from the feeding tray 24 is fed at a predetermined timing (timing corresponding to the time when the write of the latent image is started by the light beam writing device 13). The recording sheet P' adsorbed on the upper part of the transfer/feed belt 18 is fed in the direction of arrow M, passes through the first transfer position and second transfer position and is discharged by the exfoliating corotron 22. The recording sheet P' thus discharged is exfoliated from the transfer/feed belt 18 at the upper end of the driving roll 19 and fed to the fixing position where the fixing device 17 is arranged. The recording sheet P having passed the fixing device 17 is exhausted to an exhausting tray by an exhausting roll.

Referring to FIG. 7, an explanation will be given of the fixing unit Y'. The fixing device according to this embodiment includes a lot of elements having the same construction as those in the first embodiment. The elements with the same reference numerals as those in FIG. 7 are not given the detailed explanation.

The upper configuration (first fixing part Q) of the fixing device according to this embodiment with respect to the nip zone is basically the same as that in the first embodiment. The lower configuration (second fixing part R) with respect to the nip zone N is constructed of a heating roll (pressure roll) 27 having a configuration similar to that of the pressure roll 73 in the first embodiment. The heating roll 27 is different from the pressure roll 73 in the first embodiment in that it incorporates a halogen lamp (heat source) 25 with an output of 500 W to 1000 W.

The heating roll 27 has the same configuration as that of the fixing roll in a "two-roll type fixing device" in which a heat-resistant elastic layer of silicon rubber or fluororubber and a releasing layer of fluororesin are formed on the surface of a hollow cylindrical tube of stainless or aluminum.

By passing the recording sheet P' carrying the unfixed toner images (unfixed images) T (and T') through the nip zone N between the fixing belt 71 at the first fixing part Q and the heating roll 27 at the second fixing part R, the fixing by heating/pressurizing is carried out.

Now referring to FIG. 8, an explanation will be given of the image forming apparatus incorporating the fixing device according to this embodiment.

(Operation During Double-Sided Recording)

Generally, the user interface of the image forming apparatus is provided with a mode select switch, a copy start switch, etc. After the double-sided recording mode has been selected by the mode select switch, when the copy start switch is depressed, the image forming apparatus operates in the double-side recording mode. In this embodiment also, although not shown, the image forming apparatus operates likewise.

During the double-sided recording, a first tone image (unfixed image) which is an image to be formed on the one side on the surface of the photosensitive drum 11. The first toner image is transferred on the outer surface of the transfer/feed belt 18 by the first transfer device 15. The first toner image transferred on the outer surface of the transfer/feed belt 18 proceeds in a direction of arrow M so that it is fed through the upper part of the transfer/feed belt 18 and thereafter through the lower part thereof. Again, the first toner image returns to the first transfer position where the first transfer device 15 is arranged.

At the timing when the first tone image transferred on the outer surface of the transfer/feed belt 18 returned to the position of the first transfer device 15, a second toner image which is an image to be formed on another one side is formed on the surface of the photosensitive drum 11. At the timing when the second toner image and the first toner image described above move to the first transfer position, the recording sheet P' accommodated in the feeding tray 24 is fed to the outer surface of the transfer/feed belt 18 so that it is adsorbed on the outer surface of the transfer/feed belt from above the first toner image, and transferred to the first transfer position as it is.

Onto the upper side of the recording sheet P' transferred to the first transfer position, which is not in contact with the transfer/feed belt 18, the second toner image formed on the surface of the photosensitive drum 11 is transferred. Thereafter, when the recording sheet P' is fed in a direction of arrow M to reach the second transfer position, the first tone image formed on the outer surface of the transfer/feed belt 18 is now transferred to the lower side (the rear side opposite to the above upper side) of the recording sheet P' by the second transfer device 21. The recording sheet P' with the toner images thus transferred on both sides is exfoliated from the transfer/feed belt 18 by the exfoliation corotron 22 and fed to the fixing device 17.

As seen from FIG. 7, the recording sheet P' transferred to the fixing device 17 carries the toner images T and T formed on both sides thereof. When the recording sheet P' is fed in a direction of arrow M as it to pass through the nip zone between the first fixing part Q and the second fixing part R, as in the first embodiment, in the first fixing part Q, the toner image T on the upper side of the recording sheet P' is fixed by heating/pressurizing. On the other hand, in this embodiment, the surface of the heating roll 27 on the side of the second fixing part R has been also heated by the halogen lamp so that the toner image T' on the lower side of the recording sheet P' is fixed by heating/pressurizing. In short, by the fixing device according to this embodiment, both the unfixed images formed on both sides of the recording medium can be fixed through a single fixing operation. Thus, the images on both sides can be formed at a high speed, and the fixing time can be shortened, thus leading to energy saving.

(Operation During Single-Sided Recording)

Generally, in the image forming apparatus capable of forming a color image, where a monochromatic image (black toner image) is formed, a mode different from a color mode is selected by the mode select switch included in the user interface. After the type of the image has been selected by the mode select switch, when the copy start switch is depressed, the image forming apparatus operates in the full color mode or monochromatic mode according to the selected mode. In the general image forming apparatus, the mode selection affects only the formation of the unfixed image in the image forming unit. On the other hand, in the image forming apparatus according to this embodiment, the mode selection further affects the fixing unit Y.

Figure 9:
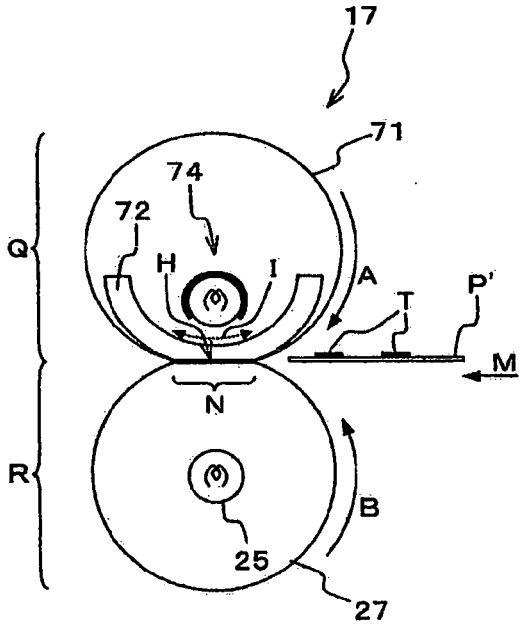
FIG. 9 is a schematic sectional view of the fixing device shown in FIG. 7 in which the monochromatic toner image formed on only the upper side of a recording sheet is fixed.

First, if the monochromatic mode is selected, only the toner image on the upper side of the recording sheet P' is formed by the image forming unit X'. The recording sheet P' is fed to the fixing unit Y'. FIG. 9 is a schematic sectional view of the fixing device according to this embodiment in which the monochromatic toner image T formed on only the upper side of the recording sheet P' is fixed. In this case, the halogen lamp 25 which is the heat source on the side of the second fixing part R is not energized so that the heating roll 27 is not heated. In this state, the recording sheet P' is passed through the nip zone N. The toner image T on the upper side of the recording sheet P' having passed through the nip zone N is fixed through heating/pressurizing by the fixing belt 71 of the first fixing part Q. Thereafter, the recording sheet P' is exhausted to the exhaust tray (not shown).

Generally, the toner image T formed using only black toner is not problematic even when it is fixed by the fixing device having a hard roll. In the case of the image forming apparatus according to this embodiment, the fixing can be realized by the first fixing part Q, which provides the hard surface due to the pressing supporting at the nip zone, but is excellent in the instant-start capability and the aptitude of high speed, thereby saving the energy.

On the other hand, if the color mode is selected, the toner image T' on the lower side of the recording sheet P' is formed by the image forming unit X'. Incidentally, in FIG. 8, for simplicity of illustration, only the arrangement corresponding to one color of the toner to be formed on the recording sheet P is shown. However, actually, the arrangement capable of forming a full-color image with three or four toner images superposed can be realized by a "tandem type image forming apparatus" in which photosensitive drums 11 corresponding to three or four colors are arranged in series in a traveling direction (direction of arrow M) of the transfer/feed belt 18, or another image forming apparatus including a rotary developer consisting of the developers 14 corresponding to three or four colors.

Figure 10:
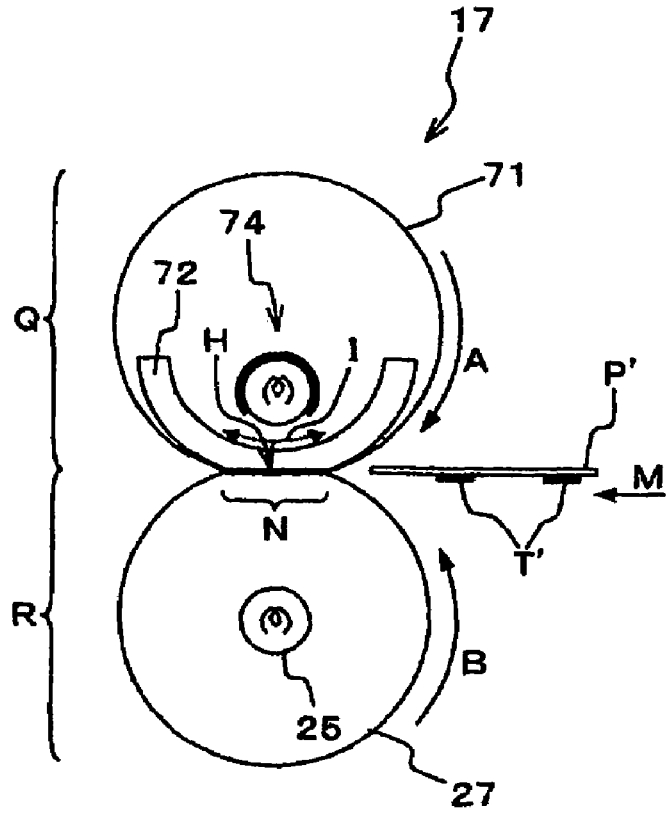
FIG. 10 is a schematic sectional view of the fixing device shown in FIG. 7 in which the full-color toner image formed on only the lower side of a recording sheet is fixed.

The recording sheet P' with the toner image T' formed on the lower side proceeds in the direction of arrow M as it is and fed to the fixing unit Y'. FIG. 10 is a schematic sectional view of the fixing device according to this embodiment in which the full-color toner image T' formed on only the lower side of the recording sheet P' is fixed. In this case, the halogen lamp 74 which is the heat source on the side of the first fixing part Q is not energized so that the fixing belt 71 is not heated. In this state, the recording sheet P' is passed through the nip zone N. The toner image T' on the lower side of the recording sheet P' having passed through the nip zone N is fixed through heating/pressurizing by the heating roll 27 of the second fixing part R. Thereafter, the recording sheet P' is exhausted to the exhaust tray (not shown).

The toner image T' with a plurality of superposed color toner layers is generally fixed by a fixing device having a soft roll in view of image quality. In the case of the image forming apparatus according to this embodiment, the fixing can be realized by the second fixing part R in which the heating roll 27 having a very soft surface is in contact with the toner image T'.

In this way, in accordance with the image forming apparatus using the fixing device according to this embodiment, the orientation of the side of the recording sheet P' when it enters the nip zone N is controlled by the fixing device 17 in the fixing unit Y according to the type (full-color or monochrome) of the toner image (T or T') formed on the surface of the recording sheet P' by the image forming unit X', thereby realizing suitable fixing according to the type of the toner image.

In the embodiment described above, the operation of the single-sided recording was explained with reference to the orientation of the side of the recording sheet P' on which the toner image is to be formed according to the type of the image was suitably selected. However, this embodiment can be suitably applied to not only the configuration of controlling the orientation of the side of the recording sheet where the toner image is to be formed according to the type of the image, but also the configuration in which the toner image is simply formed on either side of the recording sheet P' and fixed without changing the direction of passing the recording sheet through the nip zone N. In this case, where the color image is fixed, a small difference in the fixing characteristic is preferably small between the first fixing part Q and the second fixing part R. In this case, by applying an elastic layer on the fixing belt, both first fixing part Q and second fixing part R can be given a soft surface of the fixing member the fixing member in the nip zone, thereby reducing the difference in the fixing characteristic between both parts. In this way, the fixing device according to this embodiment can be used for a color double-sided fixing device. Further, by constructing the heating roll 27 in the second fixing part R as a hard roll made of the material having a high surface hardness, the image forming apparatus dedicated for the monochromatic image can be provided.

Accordingly, the image forming apparatus according to this embodiment permits the toner image on a single or double sides of the recording sheet P' to be fixed by once passing it through the fixing device during the single sided recording or double sided recording.

Since the remaining construction of this embodiment is the same as the first embodiment, this embodiment is expected to give the same effect as the first embodiment, For example, even where the recording medium P' has a multiple-layer structure such as an envelope, no wrinkle nor curl is formed, thereby improving the capability of feeding and fixing. Further, drop in the temperature of the heat-resistant endless belt is suppressed, thereby further improving the instant-start capability and also giving excellency in the aptitude of high speed.

The fixing device according to this invention is a fixing device including a pressure roll having elasticity or flexibility, which is a driving roller, a heat-resistant endless belt being in contact with the pressure roll to form a nip zone through which a recording medium passes, the heat-resistant endless belt rotating as driven by the pressure roll, a pressing supporting body disposed inside the heat-resistant endless belt and having a flat segment to press the heat-resistant endless belt for making the nip zone nearly flat, a heat source disposed inside the heat-resistant endless belt, the pressing supporting body being arranged between the heat source and the nip zone, characterized in that the heat-resistant endless belt is directly heated by radiant heat from the heat source and heated by thermal conduction through the pressing supporting body(this invention A).

In accordance with this invention, since the nip zone through the recording medium is passed is made nearly flat, sufficient pressuring force is applied to the heat-resistant endless belt by the pressure roll. Thus, when the pressure roll is rotated, both the heat-resistant endless belt and recording sheet are fed at the same speed, thereby preventing paper wrinkles or curls from occurring. In other words, the liner speed is not different between the heat-resistant endless belt and the pressure roll at the nip zone. For this reason, even when the recording sheet is a recording medium having a multi-layer structure such as an envelope, improved capability of feeding and fixing can be attained with no wrinkle or curl.

Since the heat-resistant endless belt is employed as the fixing member, the instant-start capability is inherently excellent. In addition, since the nip zone is heated by the thermal conduction through the pressing supporting body and the other area than the nip zone is heated by the radiant heat from the halogen lamp, the temperature fall in the heat-resistant endless belt is suppressed, thereby further improving the instant-start capability and also giving excellency in the aptitude of high speed.

In order to realize the fixing device according to this invention in such a manner that the heat-resistant endless belt is directly heated by radiant heat from the heat source and heated by thermal conduction through the pressing supporting body, a concrete configuration is given in which the pressing supporting body is extended centering the flat segment along an inner periphery of the heat-resistant endless belt to surround the heat source and has an opening at a position opposite to the flat segment(this invention B).

In accordance with the fixing device having such a configuration, the pressing supporting body formed in a shape surrounding the heat source is first heated by the radiant heat from the heat source and the heat-resistant endless belt in contact with the flat segment of the pressing supporting body is heated by thermal conduction. Since the flat segment corresponds to the nip zone of the fixing device, the recording sheet is effectively given heat.

Since the pressing supporting body is opened at least at a portion on the side opposite to the flat segment with the heat source as a base point, at the opened portion, the radiant heat from the heat source, without being shielded by the pressing supporting body, directly the heat-resistant endless belt. For this reason, the heat-resistant endless belt, in which heat may be absorbed at the nip zone and further cooled by the rotating operation at a further position from the flat segment of the pressing supporting body, can be directly heated at the other position than the flat segment by the radiant heat from the heat source. This provides an excellent aptitude of the fixing device. Further, since the pressing supporting body does not exist at the opened portion, the danger that the pressing supporting body is excessively heated is suppressed, thereby making it difficult to bring about the trouble such as reduction in the printing speed and stopping of the printing or making it unnecessary to take the measure for preventing such trouble.

The pressing supporting body is preferably formed over a central angle of 180° to 300° with the heat source as a base point. A lot of heat must be radiated to the pressing supporting body which conducts heat to the nip zone which directly acts on the recording medium as the fixing device. On the other hand, the region which directly heats the heat-resistant endless belt the opened portion of the pressing supporting body, which is opposite to the nip zone, does not require so much heat. Therefore, in order to radiate the heat enough to directly heat the heat-resistant endless belt from the above opened portion while effectively giving the radiant heat from the heat source to the pressing supporting body, the pressing supporting body is preferably formed in a shape suitably surrounding the heat source as described above, From the same standpoint, the heat source is preferably arranged at a position deviated from the axial central position of the heat-resistant fixing belt toward the nip zone. By arranging the heat source at a position near to the pressing supporting body, more radiant heat is projected to the pressing supporting body which requires more energy, and by arranging the heat source at a position farther from the heat-resistant endless belt, direct projection of the radiant heat to the heat-resistant endless belt which requires less energy is suppressed. Thus, the radiant heat from the heat source can be effectively employed. Incidentally, "the axial central position of the heat-resistant fixing belt" refers to the axis in the case where the outer peripheral shape of the objective heat-resistant endless belt is a shape having an axis such as a circle or ellipse, and the center of gravity of the outer peripheral shape of the objective heat-resistant endless belt in the case where it is a shape having no specific axis.

The heat-resistant endless belt preferably has at least a heat-absorbing layer. Now, the "heat-absorbing layer" refers to the layer treated to enhance the capability of heat-absorbing, for example layer colored black so that the radiant heat is easily absorbed.

Because the heat-resistant endless belt has the heat-absorbing layer, using less radiant heat, necessary heat can be given to the heat-resistant endless belt effectively in a short time.

Preferably, a thermal semi-shielding member is arranged formed in the heat source on the side opposite to the side facing the nip zone, i.e. on the side of the opened portion of the pressing supporting body. The thermal semi-shielding member serves to interrupt or reflect a part of the entire energy of the radiant heat from the opposite side. In order to project the radiant heat with sufficient energy to the nip zone, the heat source having the corresponding output is required. However, if the output of the heat source is increased, now, the radiant heat projected from the heat source through the opened portion may excessively heat the heat-resistant endless belt. In order to obviate such inconvenience, since the thermal semi-shielding member which interrupts or reflects a part of the entire energy of the radiant heat is arranged, the heat-resistant endless belt apart from the nip zone can be heated softly and suitably.

Now, the "thermal semi-shielding member" refers to a member capable of shielding (interrupt or reflect) a part of the entire energy of the radiant heat through either reflection or absorption. Concretely, the thermal semi-shielding member refers to a member which mainly shields 10 to 90% of the entire energy of the radiant heat. If the semi-reflecting film which reflects about 60% of the entire energy of the radiant heat is employed, about 40% of the entire energy of the radiant heat is used to heat the heat-resistant endless belt through radiation.

Thus, the heat-resistant endless belt can be suitably heated on the side of the pressing supporting body opposite to the nip zone so that it is heated by the radiant heat from the heat source and by thermal conduction form the pressing supporting body. Accordingly, the temperature of the heat-resistant endless belt and pressing supporting body at the nip zone can be suitably controlled to a predetermined temperature. Further, the time taken for the warm-up can be shortened (the instant-start capability can be realized).

The thermal semi-shielding member may be generally the member such as a semipermeable or semi-reflective film which can itself shield a part of the entire energy of the radiant heat. However, even when it is a member which fully reflects or absorbs the radiant heat, it may be any member which can reduce the inherent projected area by small openings made in a slit or checked shape or by its arrangement of a louver shape.

The heat source is generally a halogen lamp with a filament located at the axial center of a cylindrical glass lamp tube. In this case, the thermal semi-shielding member may be a film member covering a partial area of an outer peripheral surface of the lamp tube of the halogen lamp. In this case, the thermal semi-shielding member (hereinafter also referred to as "thermal semi-shielding film) may be concretely a ceramic coating, and is preferably white.

Incidentally, the amount of coating of the thermal semi-shielding film (semi-reflective film) is determined in view of the degree of temperature rise in the heat-resistant endless belt and that in the pressing supporting body at the nip zone, and determined according to the material, thickness, thermal capacity and making electric power of the pressing supporting body.

Where the heat source is the halogen lamp and the partial area of the outer peripheral surface of the lamp tube is covered with the film member of the thermal semi-shielding member, the peripheral surface of the lamp tube is preferably coated with the film member serving as the thermal semi-shielding member over the central angle of 180° to 270° with the filament as the central point. In this way, since the thermal semi-shielding film, which can shield a part of the energy of the radiant heat directly projected onto the heat-resistant endless belt from the opened portion from the heat source, is arranged in a suitable range as described above, the heat-resistant endless belt apart from the nip zone can be suitably heated without being excessively heated.

At least surface of the flat segment facing the heat source is preferably subjected to heat-absorbing treatment. Since the face is subjected to the heat-absorbing treatment, the heat from the heat source is effectively absorbed by the above face. The heat is conducted from the flat segment on the rear side to nip zone of the heat-resistant endless belt. In this way, the heat can be effectively given to the nip zone.

Now, the heat-absorbing treatment refers to the treatment for improving the capability of heat absorption. The treatment of blackening is an example of the heat-absorbing treatment. Provision of the heat-absorbing layer may be also an example of the heat-absorbing treatment.

The above source may be one of a plurality of heat sources disposed inside the heat-resistant endless belt. Considering the use of a small-sized sheet, the fixing device having such a configuration includes inside the heat-resistant endless belt e.g. at least two heat sources of a long halogen lamp for full size and a short halogen lamp for small size, these halogen lamps being surrounded.

In the fixing device according to this invention, the pressure roll preferably incorporates a heat source. By arranging the individual heat source in the pressure roll, the side of the pressure roll can be given the function of fixing, i.e. the recording mediumr can be passed through the nip zone so that the unfixed image on the surface thereof is in contact with the pressure roll. Thus, for example, by passing the recording medium carrying unfixed images on both sides through the nip zone, the fixing device can simultaneously fix the unfixed images carried on both sides. The passed side of the recording medium can be selected according to the type of the unfixed image formed on one side of the recording medium (The recording medium is passed through the nip zone so that for example, for a color image, the unfixed image is brought into contact with the soft pressure roll whereas for a monochromatic black image, the unfixed image is brought into contact with the heat-resistant endless belt having the excellent capability of "instant start".

On the other hand, the image forming apparatus according to this invention is an image forming apparatus including an image forming unit to form an unfixed image on a surface of a recording sheet and a fixing unit to fix the unfixed image formed on the surface of the recording sheet by heating and pressurizing, characterized in that the fixing unit is a fixing device according to this invention (this invention A or B).

Further, in the image forming apparatus according to this invention, the pressure roll in the fixing device serving as the fixing unit may include the heat source.

In this case, the face orientation of the recording medium when it enters the nip zone is controlled by the fixing device serving as the fixing unit according to the type of an unfixed image formed on the surface of the recording medium by the image forming unit. The recording medium enters the nip zone so that for example, for a color image, the unfixed image is brought into contact with the soft pressure roll whereas for a monochromatic black image, the unfixed image is brought into contact with the heat-resistant endless belt having the excellent capability of "instant start".

Further, the unfixed image is preferably formed on each of both sides of the recording medium by the image forming unit. In accordance with this embodiment, the unfixed images formed on both sides of the recording medium can be simultaneously fixed by once passing the recording medium with the unfixed images on both sides through the fixing device. This realizes the double-side image formation at a high speed and shortens the fixing time, thus leading to energy saving.

In accordance with this invention there is provided a fixing device which generates no wrinkle or curl regardless of the type of a recording medium during fixing, is good in the capability of transporting and fixing, is excellent in the instant-start capability of (realizing shortening of the warm-up time), can suppress the trouble such as stopping of printing and is excellent in the aptitude of high speed, and provide an image forming method using this fixing device.

Further, in accordance with this invention, there is provided an image forming apparatus provided with the fixing device having the above excellent characteristics. By attaching a further condition to the apparatus, there are provided an image forming apparatus suitable to form both color and monochromatic images or an image forming apparatus capable of easily forming a double-sided image with saved energy at a high speed.

The entire disclosure of Japanese Patent Application No. 2004-161216 filed on May 31, 2004 including specification, claims, drawings and abstract is incorporated herein by reference in its entirety.

What is claimed is:

1. A fixing device comprising:

a pressure roll having elasticity or flexibility, which is a driving roller;

a heat-resistant endless belt being in contact with the pressure roll to form a nip zone through which a recording medium passes, the heat-resistant endless belt rotating as driven by the pressure roll;

a pressing supporting body disposed inside the heat-resistant endless belt and having a flat segment to press the heat-resistant endless belt for making the nip zone nearly flat;

a heat source disposed inside the heat-resistant endless belt, the pressing supporting body being arranged between the heat source and the nip zone, wherein the heat-resistant endless belt is directly heated by radiant heat from the heat source and heated by thermal conduction through the pressing supporting body.

2. A fixing device comprising:

a pressure roll having elasticity or flexibility, which is a driving roller;

a heat-resistant endless belt being in contact with the pressure roll to form a nip zone through which a recording medium passes, the heat-resistant endless belt rotating as driven by the pressure roll;

a pressing supporting body disposed inside the heat-resistant endless belt and having a flat segment to press the heat-resistant endless belt for making the nip zone nearly flat;

a heat source disposed inside the heat-resistant endless belt, the pressing supporting body being arranged between the heat source and the nip zone, wherein the pressing supporting body is extended centering the flat segment along an inner periphery of the heat-resistant endless belt to surround the heat source and has an opening at a position opposite to the flat segment.

3. The fixing device according to claim 2, wherein the pressing supporting body is formed over a central angle of 180° to 300° with the heat source as a base point.

4. The fixing device according to claim 2, wherein the heat source is arranged at a position deviated from an axial central position of the heat-resistant endless belt toward the nip zone.

5. The fixing device according to claim 2, wherein the heat-resistant endless belt has at least a heat-absorbing layer.

6. The fixing device according to claim 2, further comprising:

a thermal semi-shielding member formed on the heat source on a side opposite to the side facing the nip zone, wherein the thermal semi-shielding member interrupts or reflects a part of an entire energy of the radiant heat from the opposite side.

7. The fixing device according to claim 6, wherein the heat source is a halogen lamp with a filament located approximately at the axial center of a cylindrical glass lamp tube, and the thermal semi-shielding member is a film member covering a partial area of an outer peripheral surface of the lamp tube of the halogen lamp.

8. The fixing device according to claim 7, wherein the thermal semi-shielding member is a ceramic coating.

9. The fixing device according to claim 8, wherein the ceramic coating serving as the thermal semi-shielding member is white.

10. The fixing device according to claim 7, wherein the outer peripheral surface of the lamp tube is covered with a film member serving as the thermal semi-shielding member over the central angle of 180° to 270° with the filament as a central point.

11. The fixing device according to claim 2, wherein at least a surface of the flat segment facing the heat source is subjected to heat-absorbing treatment.

12. The fixing device according to claim 2, wherein the heat source is one of a plurality of heat sources disposed inside the heat-resistant endless belt.

13. The fixing device according to claim 2, wherein the pressure roll has a heat source inside thereof.

14. The fixing device according to claim 13, wherein the recording medium passing through the nip zone carries unfixed images on both sides thereof and the unfixed images are simultaneously fixed to the recording medium while it passing through the nip zone.

15. An image forming apparatus comprising:

an image forming unit that forms an unfixed image on a surface of a recording medium; and a fixing unit that fixes the unfixed image formed on the surface of the recording medium by heating and pressurizing, wherein the fixing unit includes:

a pressure roll having elasticity or flexibility, which is a driving roller;

a heat-resistant endless belt being in contact with the pressure roll to form a nip zone through which a recording medium passes, the heat-resistant endless belt rotating as driven by the pressure roll;

a pressing supporting body disposed inside the heat-resistant endless belt and having a flat segment to press the heat-resistant endless belt for making the nip zone nearly flat;

a heat source disposed inside the heat-resistant endless belt, the pressing supporting body being arranged between the heat source and the nip zone, wherein the heat-resistant endless belt is directly heated by radiant heat from the heat source and heated by thermal conduction through the pressing supporting body.

16. An image forming apparatus comprising:

an image forming unit that forms an unfixed image on a surface of a recording medium; and a fixing unit that fixes the unfixed image formed on the surface of the recording medium by heating and pressurizing, wherein the fixing unit includes:

a pressure roll having elasticity or flexibility, which is a driving roller;

a heat-resistant endless belt being in contact with the pressure roll to form a nip zone through which a recording medium passes, the heat-resistant endless belt rotating as driven by the pressure roll;

a pressing supporting body disposed inside the heat-resistant endless belt and having a flat segment to press the heat-resistant endless belt for making the nip zone nearly flat;

a heat source disposed inside the heat-resistant endless belt, the pressing supporting body being arranged between the heat source and the nip zone, wherein the pressing supporting body is extended centering the flat segment along an inner periphery of the heat-resistant endless belt to surround the heat source and has an opening at a position opposite to the flat segment.

17. The image forming apparatus according to claim 16, wherein the pressure roll incorporates a heat source.

18. The image forming apparatus according to claim 17, wherein, according to a type of the unfixed image formed on the surface of the recording medium, face orientation of the recording medium is controlled by the fixing unit when the recording medium enters the nip zone.

19. The image forming apparatus according to claim 17, wherein the unfixed image is formed on each of both sides of the recording medium by the image forming unit.

* * * * *